US009507970B2

(12) United States Patent
Al-Absi et al.

(10) Patent No.: US 9,507,970 B2
(45) Date of Patent: Nov. 29, 2016

(54) CMOS CURRENT-MODE SQUARING CIRCUIT

(71) Applicant: KING FAHD UNIVERSITY OF PETROLEUM AND MINERALS, Dhahran (SA)

(72) Inventors: Munir A. Al-Absi, Dhahran (SA); Ibrahim Ali As-Sabban, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 0 days.

(21) Appl. No.: 15/076,599

(22) Filed: Mar. 21, 2016

(65) Prior Publication Data

US 2016/0283752 A1 Sep. 29, 2016

Related U.S. Application Data

(60) Provisional application No. 62/137,208, filed on Mar. 23, 2015.

(51) Int. Cl.
*G06G 7/20* (2006.01)
*G06G 7/14* (2006.01)

(52) U.S. Cl.
CPC . *G06G 7/20* (2013.01); *G06G 7/14* (2013.01)

(58) Field of Classification Search
CPC ..... G06G 7/14
See application file for complete search history.

(56) References Cited

U.S. PATENT DOCUMENTS

| | | | | |
|---|---|---|---|---|
| 5,920,774 | A | 7/1999 | Wu | |
| 6,621,308 | B2 | 9/2003 | Tinsley et al. | |
| 6,856,796 | B2 | 2/2005 | Ding et al. | |
| 7,952,395 | B2 * | 5/2011 | Abuelma'atti | G06G 7/28 327/105 |
| 2015/0123724 | A1 * | 5/2015 | Al-Absi | G06G 7/20 327/347 |

OTHER PUBLICATIONS

Al-Absi, M.A. and As-Sabban, I.A., "A new current-mode squaring circuit with compensation for error resulting from carrier mobility reduction," 2013 8th International Conference on Electrical and Electronics Engineering (ELECO), pp. 358-361, Bursa, Turkey, Nov. 28-30, 2013.

* cited by examiner

*Primary Examiner* — Hai L Nguyen
(74) *Attorney, Agent, or Firm* — Richard C. Litman

(57) ABSTRACT

The CMOS current-mode squaring circuit includes a translinear loop. A rectifier is used to produce the absolute value of the input current. Carrier mobility reduction is taken into consideration to compute the drain current for short channel MOSFETs. Careful selection of CMOS aspect ratios provides error compensation due to carrier mobility reduction.

5 Claims, 3 Drawing Sheets

CMOS CURRENT-MODE SQUARING CIRCUIT

CROSS-REFERENCE TO RELATED APPLICATION

This application claims the benefit of U.S. Provisional Patent Application Ser. No. 62/137,208, filed Mar. 23, 2015.

BACKGROUND OF THE INVENTION

1. Field of the Invention

The present invention relates to CMOS electronic circuits, and particularly to a CMOS current-mode squaring circuit.

2. Description of the Related Art

The squaring circuit is a very important building block in analog signal processing applications. This includes, but is not limited to, RMS-DC converters, pseudo-exponential cells, CMOS companding filters, fuzzy control, multipliers, etc.

A number of squaring circuits have been published in the literature. They can be categorized into three modes, including voltage-mode, current-mode, and voltage/current-mode.

It is well known that current-mode circuits are better than their voltage-mode counterpart circuits because they offer high bandwidth, larger dynamic range, simple circuitry, and lower power consumption. Squaring circuits designed using MOSFET in saturation can be classified in two categories. The first category is the direct approach using a MOS translinear loop. The second approach uses an analog multiplier to obtain the squaring output. This multiplier can be designed with a MOS transistor operated in the saturation region, or both a saturation and a triode region.

Due to the scaling down in the dimensions of the MOSFET transistor, a transistor model that accounts for second order effects has to be used in the analysis and simulation of circuits under consideration.

Thus, a CMOS current-mode squaring circuit addressing the aforementioned problems is desired.

SUMMARY OF THE INVENTION

The CMOS current-mode squaring circuit includes a translinear loop. A rectifier is used to produce the absolute value of the input current. Carrier mobility reduction is taken into consideration to compute the drain current for short channel MOSFETs. Careful selection of CMOS aspect ratios provides compensation for the error due to carrier mobility reduction.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
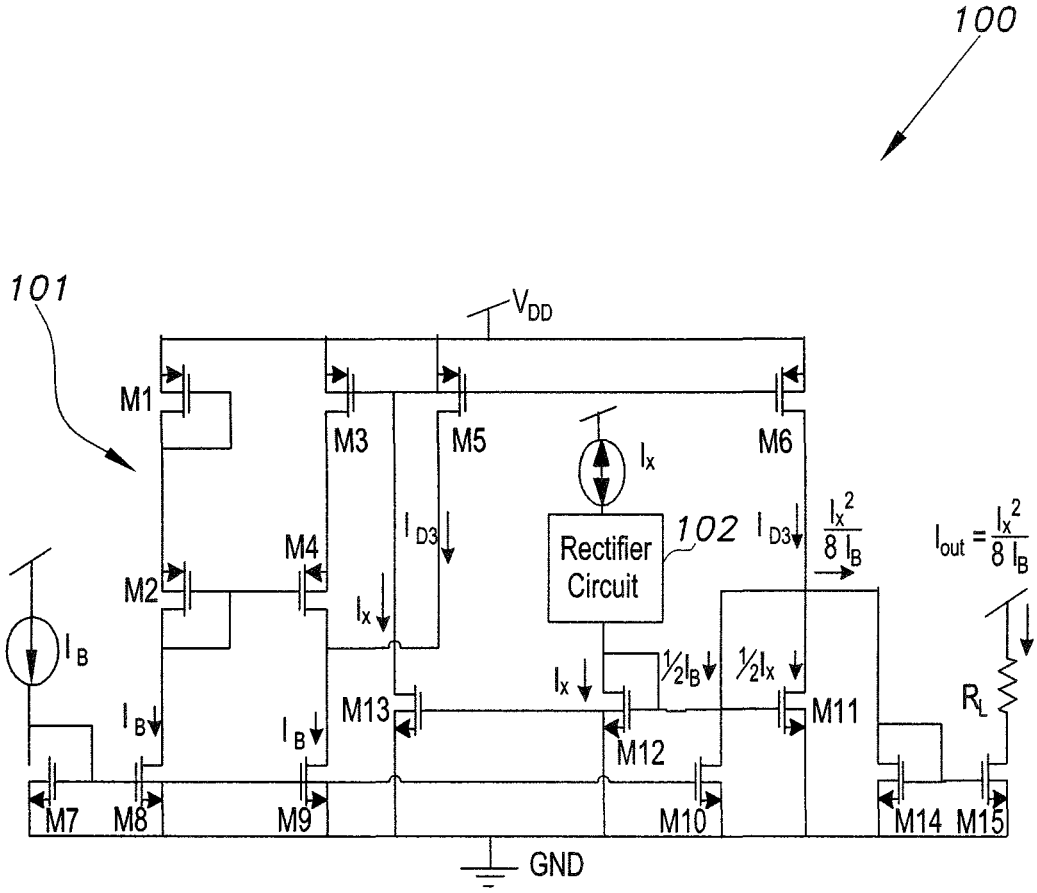
FIG. 1 is a schematic diagram of a current-mode squaring circuit according to the present invention.
Figure 2:
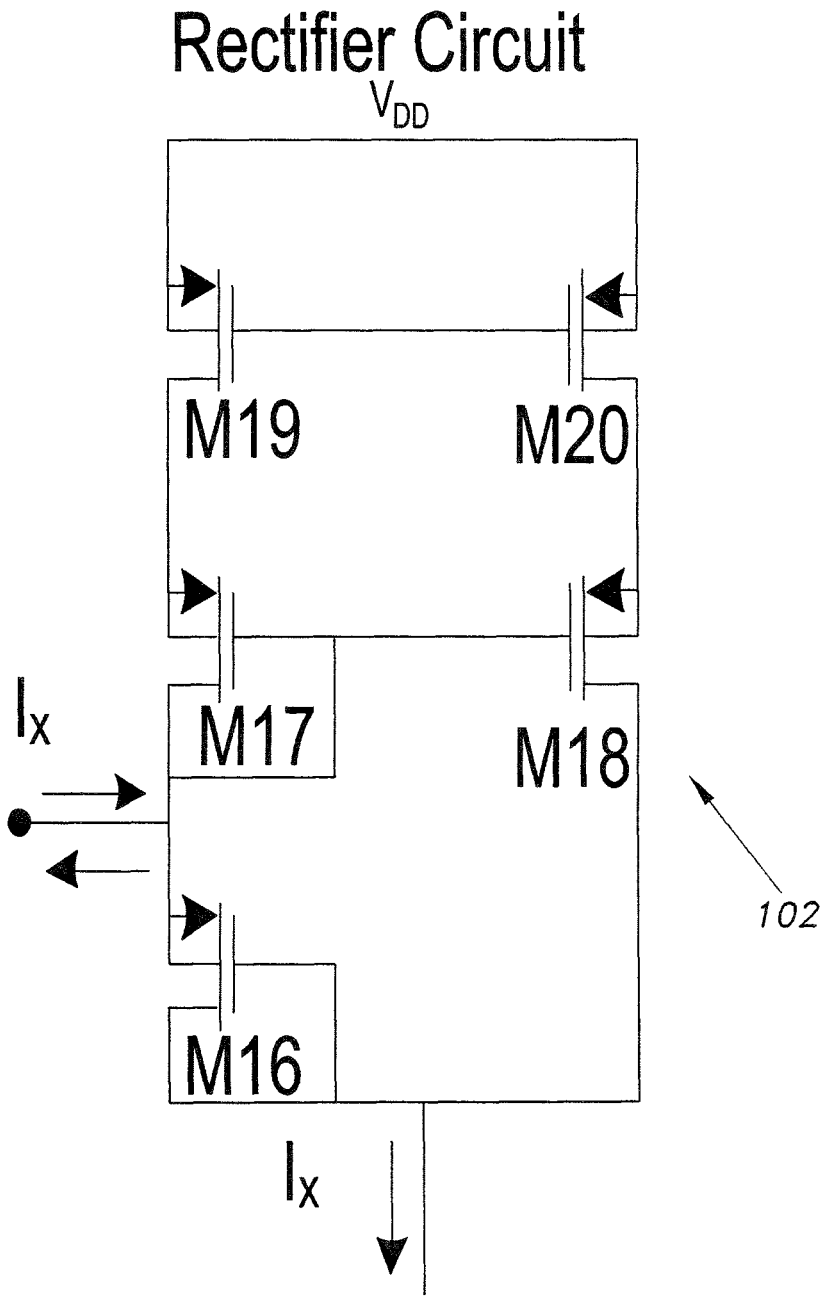
FIG. 2 is a schematic diagram of a rectifier circuit used in the current-mode squaring circuit of FIG. 1.

A schematic diagram of the CMOS current-mode squaring circuit 100 is shown in FIG. 1. The CMOS current-mode squaring circuit 100 has a core translinear loop circuit 101 formed by transistors (M1-M4). The current $I_B$ is the bias current and $I_x$ is the input current. It will be shown that the output current is given by $I_{out}=I_x^2/8I_B$. The rectifier circuit 102 is used to produce the absolute value of $I_x$, which will allow the input current to be positive or negative. Considering transistors M1 -M4 as a MOSFET translinear loop (MTL), we derive:

$$V_{SG1}+V_{SG2}=V_{SG3}+V_{SG4}. \tag{1}$$

If carrier mobility reduction is taken into consideration, the drain current for a short channel MOSFET is given by:

$$I_D = \frac{\beta}{2}\frac{(V_{GS}-V_{TH})^2}{1+\theta(V_{GS}-V_{TH})}, \tag{2}$$

where θ is a fitting parameter and β=μCoxW/L is the transconductance of the transistor. Using equation (2), the gate-to source potential can be written as:

$$V_{GS} \approx \frac{I_D\theta}{\beta} + \sqrt{\frac{2I_D}{\beta}} + V_{TH}. \tag{3}$$

Combining equations (1) and (3) results in:

$$\frac{I_{D1}\theta_1}{\beta_1} + \sqrt{\frac{2I_{D1}}{\beta_1}} + \frac{I_{D2}\theta_2}{\beta_2} + \sqrt{\frac{2I_{D2}}{\beta_2}} = \frac{I_{D3}\theta_3}{\beta_3} + \sqrt{\frac{2I_{D3}}{\beta_3}} + \frac{I_{D4}\theta_4}{\beta_4} + \sqrt{\frac{2I_{D4}}{\beta_4}}. \tag{4}$$

Assuming the aspect ratios of transistors M1-M4 satisfy the condition $\beta_1=\beta_2\beta_2=2\beta$. $\beta_3=\beta_4=\beta$ and $\theta_1\theta_2=_3=\theta_4=\theta$, then equation (4) can be rewritten as:

$$\frac{I_{D1}\theta}{2\beta} + \sqrt{\frac{2I_{D1}}{2\beta}} + \frac{I_{D2}\theta}{2\beta} + \sqrt{\frac{2I_{D2}}{2\beta}} = \frac{I_{D3}\theta}{\beta} + \sqrt{\frac{2I_{D3}}{\beta}} + \frac{I_{D4}\theta}{\beta} + \sqrt{\frac{2I_{D4}}{\beta}}. \tag{5}$$

With reference to circuit 100 of FIG. 1, the drain current of transistors M1 and M2 are the same, so that equation (5) can be expressed by:

$$\frac{\theta}{\beta}I_B + \frac{1}{\sqrt{\beta}}\left[2\sqrt{I_B}\right] = \frac{\theta}{\beta}[I_{D3}+I_{D4}] + \frac{1}{\sqrt{\beta}}\left[\sqrt{2I_{D3}} + \sqrt{2I_{D4}}\right]. \tag{6}$$

To compensate for the error due to carrier mobility reduction, the terms containing θ should be cancelled. To do this, the following condition should be imposed:

$$\frac{\theta}{\beta}I_B = \frac{\theta}{\beta}[I_{D3}+I_{D4}] \qquad I_B = I_{D3}+I_{D4}. \tag{7}$$

The circuit is designed to account for the condition in equation 7. Using equation (7), equation (6) can be rewritten as:

$$\frac{1}{\sqrt{\beta}}[2\sqrt{I_B}] = \frac{1}{\sqrt{\beta}}[\sqrt{2I_{D3}} + \sqrt{2I_{D4}}]. \tag{8}$$

Equation (8) can be rewritten as:

$$\sqrt{2I_{D4}}=2\sqrt{I_B}-\sqrt{2I_{D3}}. \tag{9}$$

From the schematic in FIG. 1 showing circuit 100, with current $I_x$ mirrored in transistor M13 and $I_{D3}$ being mirrored in M5 and M6, we obtain:

$$I_{D3}=I_X+I_{D4}. \tag{10}$$

Combining equations (9) and (10), the drain current for M4 is given by:

$$I_{D4} = \frac{I_B}{2} - \frac{I_X}{2} + \frac{I_X^2}{8I_B}. \tag{11}$$

Combining equations (10) and (11) yields:

$$I_{D3} = I_X + \frac{I_B}{2} - \frac{I_X}{2} + \frac{I_X^2}{8I_B} = \frac{I_X}{2} + \frac{I_B}{2} + \frac{I_X^2}{8I_B}. \tag{12}$$

The first two terms to the right are subtracted using transistors M12 and M13, and the output is mirrored via M14 and M15, respectively, to get:

$$I_{out} = \frac{I_x^2}{8I_B}. \tag{13}$$

Equation 13 can be written as:

$$I_{out}=kI_x^2, \tag{14}$$

where $k=1/8I_B$. It is clear that equation (14) implements a squaring circuit with compensation for error due to carrier mobility reduction.

The functionality of the present design is confirmed using Tanner T-spice in 0.18 μm CMOS process technology. The bias current is 60 μA and the input current is swept from −40-to-40 μA. The circuit is operated from a 1.5V DC supply. The aspect ratios of all transistors used are shown in Table 1.

TABLE 1

Transistor aspect ratios used in simulation

| | W/L (μm) |
|---|---|
| M1 | 5.0/0.2 |
| M2 | 5.0/0.2 |
| M3 | 2.5/0.2 |
| M4 | 2.5/0.2 |
| M5 | 2.5/0.2 |
| M6 | 2.5/0.2 |
| M7 | 5.0/0.2 |
| M8 | 5.0/0.2 |
| M9 | 5.0/0.2 |
| M10 | 2.5/0.2 |
| M11 | 2.5/0.2 |
| M12 | 5.0/0.2 |
| M13 | 5.0/0.2 |
| M14 | 0.3/0.5 |
| M15 | 0.3/0.5 |
| M16 | 5.0/0.2 |
| M17 | 5.0/0.2 |
| M18 | 5.0/0.2 |
| M19 | 5.0/0.2 |
| M20 | 5.0/0.2 |

Figure 3:
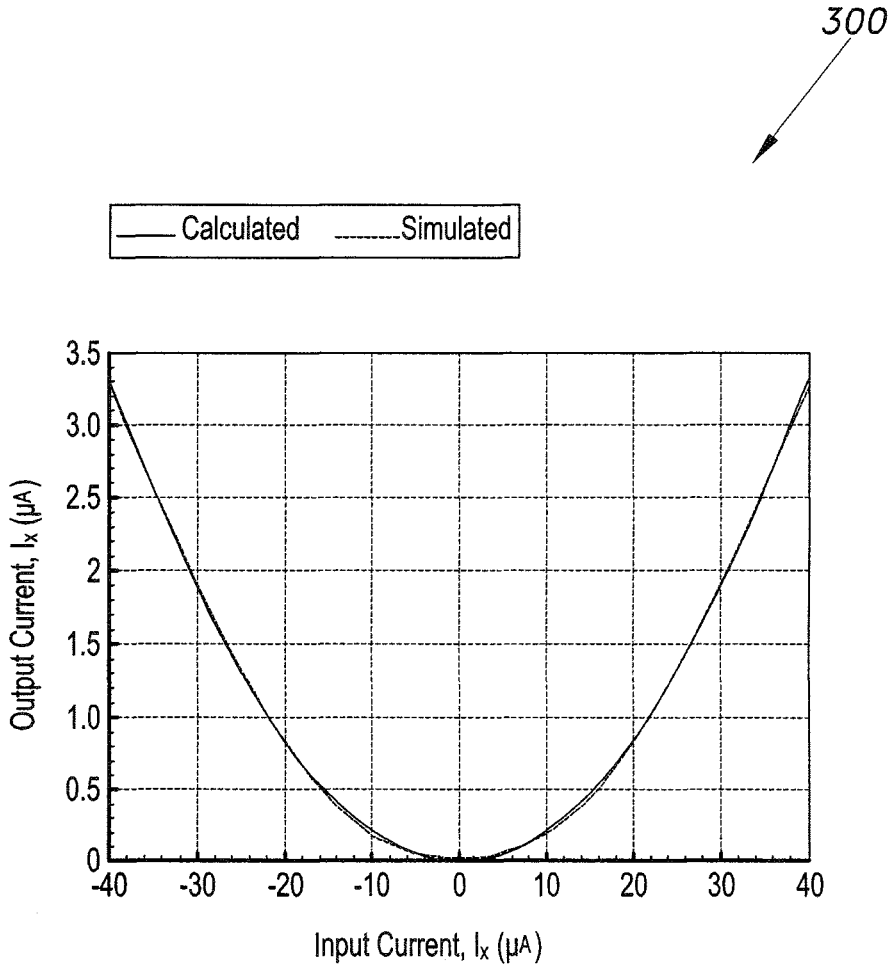
FIG. 3 is a plot showing DC simulation results for the current-mode squaring circuit of FIG. 1.

A plot of the DC transfer characteristic of the squaring circuit for calculated and simulated results is shown in FIG. 3. It is clear from plot 300 that the proposed design is in close agreement with the theory.

In the proposed circuit if we consider that a worst case in which transistors M1 and M4 in the MTL have threshold voltage mismatch, then:

$$V_{GS1} \approx \frac{I_{D1}\theta}{\beta} + \sqrt{\frac{2I_{D1}}{\beta}} + (V_{TH} + \Delta V_{TH}), \tag{15}$$

and $$V_{GS4} \approx \frac{I_{D4}\theta}{\beta} + \sqrt{\frac{2I_{D4}}{\beta}} + (V_{TH} - \Delta V_{TH}). \tag{16}$$

The error due to threshold mismatch is given by:

$$I_{error} = |I_{out} - I'_{out}| = \left|\Delta V_{TH}\sqrt{\frac{\beta}{I_B}} \times (I_X + 2I_B)\right|. \tag{17}$$

To evaluate the error due to threshold mismatch considering the worst case of all parameters in equation (17), select $I_x$=40 μA, $I_B$=60 μA, β=86 μA/V$^2$, L=0.22 μm, and $$\Delta V_{TH} = \frac{4.432\times10^{-9}}{\sqrt{W\times L}} = \frac{4.432\times10^{-9}}{\sqrt{6\times10^{-6}\times0.22\times10^{-6}}} = 3.85\text{ mV},$$

where the maximum error is 0.737 μA which is equivalent to 1.8%.

The same two transistors were used to study the effect of mismatch in the channel length of transistors M1 and M4. The gate to source voltages are given by:

$$V_{GS1} = \frac{I_{D1}\theta_1\left(\frac{L+\Delta L}{L}\right)}{\beta_1} + \sqrt{\frac{2I_{D1}\left(\frac{L+\Delta L}{L}\right)}{\beta_1} + V_{TH}}, \tag{18}$$

and $$V_{GS4} = \frac{I_{D4}\theta_4\left(\frac{L-\Delta L}{L}\right)}{\beta_4} + \sqrt{\frac{2I_{D4}\left(\frac{L+\Delta L}{L}\right)}{\beta_4} + V_{TH}}. \tag{19}$$

The error due to channel length mismatch is given by:

$$I_{error} = |I_{out} - I'_{out}| = \left|\frac{\theta\Delta L}{4L\sqrt{\beta\times I_B}}(2I_B^2 - 2I_x^2 - 3I_xI_B)\right|. \tag{20}$$

To evaluate the error due to channel length mismatch considering the worst case of all parameters in equation (20), select $I_x$=0 μA, $I_B$=60 μA, θ=0.25V$^{-1}$, L=0.22 μm, and ΔL=0.02×0.22=0.0044 μA. The maximum error is 0.125 μA, which is equivalent to 0.3%.

Monte Carlo analysis was carried out with sigma variation of 0.0044 μm (0.02 μm channel length variation). Simulation results indicate that the circuit is almost insensitive to channel length mismatch in the MTL (MOSFET translinear loop).

It is to be understood that the present invention is not limited to the embodiments described above, but encompasses any and all embodiments within the scope of the following claims.

We claim:

1. A CMOS current-mode squaring circuit, comprising:

a translinear loop circuit accepting an input current, $|I_x|$;

a rectifier circuit in operable communication with the translinear loop circuit, the rectifier circuit providing the input current $|I_x|$ to the translinear loop circuit;

a current mirror circuit connected to the translinear loop circuit; and a current subtracting circuit connected to the current mirror circuit, the current subtracting circuit having an output characterized by:

$$I_{out} = \frac{I_x^2}{8I_B},$$

where $I_B$ is the bias current of the translinear loop circuit.

2. The CMOS current-mode squaring circuit according to claim 1, wherein the translinear loop circuit comprises a first and a second pair of CMOS transistors, the first pair having equal aspect ratios of W/L, the second pair having equal aspect ratios of 0.5 W/L, where W is a CMOS gate channel width and L is a CMOS gate channel length.

3. The CMOS current-mode squaring circuit according to claim 2, wherein the rectifier circuit comprises a plurality of rectifier circuit CMOS transistors, each of the CMOS transistors of the rectifier circuit having an aspect ratio of 0.5 W/L.

4. The CMOS current-mode squaring circuit according to claim 3, wherein the current subtracting circuit comprises a pair of current subtracting CMOS transistors, each of the CMOS transistors having an aspect ratio of W/L.

5. The CMOS current-mode squaring circuit according to claim 4, wherein the current mirror circuit comprises a pair of current mirror CMOS transistors, each of the CMOS transistors having an aspect ratio of 0.06 W/2.5 L.

* * * * *